US008523160B2

(12) United States Patent
Wilturner

(10) Patent No.: US 8,523,160 B2
(45) Date of Patent: Sep. 3, 2013

(54) CLAMP FOR SCREEN PRINTING

(76) Inventor: Derrick Wilturner, Pearland, TX (US)

( * ) Notice: Subject to any disclaimer, the term of this patent is extended or adjusted under 35 U.S.C. 154(b) by 0 days.

(21) Appl. No.: 13/407,127

(22) Filed: Feb. 28, 2012

(65) Prior Publication Data

US 2012/0222287 A1 Sep. 6, 2012

Related U.S. Application Data

(60) Provisional application No. 61/448,903, filed on Mar. 3, 2011.

(51) Int. Cl.
*B25B 1/00* (2006.01)

(52) U.S. Cl.
USPC ..... 269/86; 269/43; 269/71

(58) Field of Classification Search
USPC ..... 269/86, 43, 45, 71, 95, 87, 271
See application file for complete search history.

(56) References Cited

U.S. PATENT DOCUMENTS 979,305 A * 12/1910 Hunt ..... 269/9
2,642,905 A 6/1953 Hewat
3,190,638 A 6/1965 Court
3,222,055 A 12/1965 Cook
4,426,055 A * 1/1984 Reedy et al. ..... 248/184.1
D302,380 S 7/1989 Garvis
4,938,130 A 7/1990 Thorpe
4,949,635 A 8/1990 Padula
4,962,918 A 10/1990 Yang
5,092,572 A * 3/1992 Litwak et al. ..... 5/600
5,630,576 A * 5/1997 Williams ..... 269/45
7,114,714 B2 10/2006 Wong
2012/0222287 A1 * 9/2012 Wilturner ..... 29/559

* cited by examiner

*Primary Examiner* — Lee D Wilson
(74) *Attorney, Agent, or Firm* — Andrew W. Chu; Craft Chu PLLC

(57) ABSTRACT

An embodiment of the present invention is a clamp system for use in screen printing, including first and second jaw members, screws, an extension member, and a registration pin. The jaw members are aligned and have respective facing flat surfaces and openings. The screws threadedly connect to respective openings and set the distance between jaw members for clamping a frame. The extension member remains flush to the flat surface of the first jaw member and has a housing extending orthogonal to alignment of the jaw members. The registration pin engages a hole on the housing and extends parallel to jaw members and orthogonal to the housing. The blunt end of the pin abuts a platen. All platens maintain the same position relative to the frame, when abutting the blunt end. The registration of platens to the frame allows for multiple consistent ink application onto a substrate.

17 Claims, 2 Drawing Sheets

CLAMP FOR SCREEN PRINTING

RELATED U.S. APPLICATIONS

The present application claims priority under U.S. Code Section 119(e) from a provisional patent application, U.S. Patent Application No. 61/448,903, filed on 3 Mar. 2011 and entitled "CLAMP FOR SCREEN PRINTING".

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to a clamp. More particularly, the present invention relates to a clamp for screen printing. The clamp increases the service life of screen printing equipment.

2. Description of Related Art Including Information Disclosed Under 37 CFR 1.97 and 37 CFR 1.98

Screen printing is a technique in the field of art involving ink pressed through a mesh screen onto a substrate, such as a canvas or a t-shirt. The mesh is usually woven and treated with an ink-blocking stencil so that the ink only passes through selected portions of the screen. The ink forms a pattern on the substrate as a roller, squeegee, or other scraping means pushes the ink across the screen. Screen printing is also known as silkscreen or seriography.

The screen includes porous woven fabric or mesh extended or a frame piece. The mesh can be made of manufactured materials, such as nylon and polyester or organic materials, such as silk. The frame is comprised of wood, metal, or other suitable material. The pattern on the screen is created by non-permeable material covering areas of the screen, similar to a stencil. The uncovered areas of the screen show the pattern, while the covered areas form a negative image of the pattern. The ink presses through these uncovered areas. There are known treatments for heat or light treatment of the screen with the stencil.

The ink pattern is applied to a substrate underneath the screen. As the ink is loaded onto one edge of the screen, a floodbar or scraping means moves the ink evenly across the screen so that the ink falls through the holes in the mesh only in the selected open areas of the screen. As such, the ink pattern is applied to the substrate by the slight downward force of the scraping action. Other slight variations in the process are possible, including separating the steps of filling the open areas of the mesh and contacting the substrate. In that variation, a roller or squeegee applies the downward force from mesh to substrate separate from the ink application. Multi-color patterns are possible with variations in the mesh for each color and allowing a drying time between ink applications.

The working life of a patterned screen can increase if used for more than one pattern. The coated material can be removed from the mesh with chemical treatment by liquids, gels, or powders. The screen must be thoroughly cleaned before re-use with a new pattern of coated material.

Importantly, it is common to use a coated screen multiple times. It is unlikely that there will only be a single substrate for ink application, especially considering the amount of work and effort required for the patterned coating process for the screen. The types of substrates can vary, and the screen can apply the ink pattern on a wide variety of objects, including caps, balloons, stickers, posters, etc. The number of substrates can also vary, such as several hundred t-shirts or several thousand t-shirts. In order to insure consistent placement on multiple repeated substrates, the current technology has developed a platen to be used in conjunction with the screen. The platen is a mounting board for positioning the substrate. The platen and screen engage each other so that the relative position of the platen to the screen can be maintained each time the platen and screen are connected. In this manner, consistent mounting of the substrate on the platen and consistent positioning of the platen relative to the screen insures consistent application of the ink pattern on the same location on the substrate. Various means have been used to consistently position the platen relative to the screen, including clamps attached to the screen and alignment pins. The platen technology is especially important for using multiple color applications on the same substrate. New techniques and tools for consistent ink application on each substrate continue to be developed.

In the past, various patents have issued relating to devices to consistently position the platen relative to the screen in screen printing. For example, U.S. Pat. No. 3,222,055, issued to Cook on Dec. 7, 1965 discloses clamps with dual threaded jaws. The jaw elements are connected by screw threads that adjust the distance between the jaws for clamping. The invention shows the flush contact of the jaws on the item to be clamped.

U.S. Pat. No. 4,962,918, issued to Yang on Oct. 16, 1990 teaches a clamping set having double-coordinate clamping function and being extensible for adjusting clamp depth. The clamping action occurs in more than one dimension, wherein a sliding member engages the C-clamp portion of the device. The threaded screw on the sliding member can be set perpendicular to the clamp.

U.S. Pat. No. 4,938,130, issued to Thorpe on Jul. 3, 1990, describes a screen printing registration device and registration method. The '130 patent addresses the exact problem of consistent alignment of the platen and frame for multiple applications or re-applications. The clamp of the invention uses a pin on the platen to insure alignment of every clamped frame.

U.S. Pat. No. 2,642,905, issued to Hewat on Jun. 23, 1953, shows a work holding clamp with an angularly adjustable pressure element. This clamp features the usual elements, such as vertical screw threads and a clamping surface, but it also has spaces for other screws to engage the clamp at adjustable angles. This is useful for irregularly shaped projects, or ones where the project may be worked on after being positioned into the clamp.

U.S. Pat. No. 4,949,635, issued to Padula on Aug. 21, 1990, discloses a textile printing apparatus for multicolor printing. It contains a plurality of upper and lower arms radiating from a central hub and axle and which are rotatable with respect to one another. The lower arms have platforms for receiving textile workpieces, and the upper arms have clamping means for holding a stencil on top of a workpiece.

holder.

It is an object of the present invention to provide a clamp means for identical placement of platens relative to a frame during the screen printing process.

It is another object of the present invention to provide a clamp means, which increases the working life of the framed screen of the screen printing process.

It is an object of the present invention to provide a clamp means removably attached to the frame of a screen of the screen printing process.

It is another object of the present invention to provide a clamp means friction fit onto the frame of a screen of the screen printing process.

It is another object of the present invention to provide a clamp system, which maintains clamping force with reduced risk of mechanical failure.

It is an object of the present invention to provide a clamp system with reduced risk of damage to the frame of the screen.

It is still another object of the present invention to provide a clamp means with an adjustable alignment pin.

It is another object of the present invention to provide an adjustable alignment pin parallel to the jaw members of the clamp system.

It is still another object of the present invention to provide an adjustable alignment pin with improved resistance to deformations and/or buckling.

It is an object of the present invention to provide a clamp system, which is easier and lighter to transport and carry.

These and other objects and advantages of the present invention will become apparent from a reading of the attached specification and claims.

SUMMARY OF THE INVENTION

An embodiment of the present invention is a clamp system for use with screen printing equipment. The clamp system attaches to the frame with the mesh screen and aligns the frame with a platen, which holds the substrate. Thus, the frame and each platen are consistently aligned for repeating ink application at the same location on each substrate. The clamp system includes first and second jaw members, screws, an extension member, and a registration pin. The jaw members are aligned and have respective flat surfaces facing each other and openings aligned with each other. The screws threadedly connect the complementary openings and set the distance between jaw members for clamping action on the frame of the equipment. The flat surfaces of the jaw members abut against the frame. The extension member attaches to an end of the first jaw member and has a housing extending orthogonal to the alignment of the jaw members. The registration pin threadedly engages a hole on the housing and extends parallel to the jaw members and orthogonal to the housing. The blunt end of the pin extends from the frame and can be abutted against the platen. Each platen maintains the same position relative to the frame, whenever the blunt end contacts each platen. Thus, the registration of each platen to the frame allows for multiple consistent ink application onto the substrate.

The clamp system further includes the extension member made integral with the first jaw member or the extension member as an outer sheath mounted on the first jaw member. In this manner, the first and second jaw members are not interchangeable. The screws can also be replaced for other suitable connecting means between the jaw members, such as friction fit housings and ends made integral with the jaw members. Other embodiments include a system with primary and secondary clamps connected by a mounting bar. Each clamp has a respective set of first and second jaw members. The mounting bar also abuts against the frame for easier alignment of the clamps.

DETAILED DESCRIPTION OF THE DRAWINGS

Figure 1:
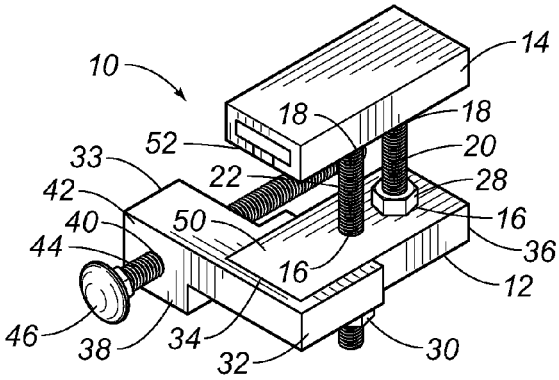
FIG. 1 is a perspective view of an embodiment of the clamp system of the present invention.

Referring to FIGS. 1-7, embodiments of the clamp system 10 of the present invention are accessories for use with screen printing equipment, which includes a screen, a platen, ink, a roller, and a substrate. The screen is made of a frame, usually wood, and mesh stretched across the frame. The substrate, such as a t-shirt, is set on a platen. In the prior art, mounts are drilled into the wood frame with a registration pin, so that the platen abuts against the registration pin to consistently align the substrate on the platen underneath the frame. The embodiments of the clamp system 10 of the present invention removably attach to the frame. Thus, the frame and platen are consistently aligned for repeating ink application at the same location on each substrate, and there is no permanent alteration of the frame. The embodiments of the clamp system 10 include a first jaw member 12, a second jaw member 14, screw means 20, 22, an extension member 32, and a registration pin 44.

Figure 2:
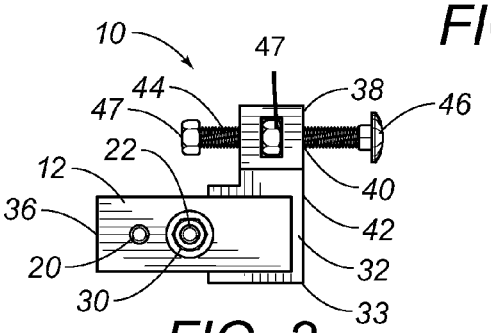
FIG. 2 is a top plan view of the embodiment of the clamp system of the present invention of FIG. 1.

FIGS. 1 and 2 show the first jaw member 12 aligned end to end with the second jaw member 14. The jaw members 12, 14 are not required to have identical size, but they must be aligned in a parallel relationship. The jaw members 12, 14 are parallel with a respective flat surface 50 of the first jaw member 12 facing a complementary flat surface 52 of the second jaw member 14. The frame is positioned between these two flat surfaces 50, 52 without altering the frame. Each jaw member 12, 14 also has a plurality of openings 16, 18, wherein the openings 16 of the first jaw member 12 are aligned with the openings 18 of the second jaw member 14. FIGS. 1-2 indicate that the openings 16, 18 can be threaded. In one embodiment, FIGS. 1, 2, 6, and 7, show each jaw member 12, 14 being comprised of an outer casing and an inner core. In this embodiment, the openings 16, 18 extend through both the outer casing and inner core of the first jaw member 12, but only through the inner core of the second jaw member 14. Also, the openings 16, 18 are placed linearly along a length of each respective jaw member 12, 14. Embodiments of FIGS. 1-7 show the openings 16, 18 linear and parallel to edges of each respective jaw member. The embodiments of FIGS. 1-7 show two openings as the plurality of openings 16, 18, although alternate numbers of sets of openings are also possible. Any embodiment of FIGS. 1-7 may be comprised of aluminum for the jaw members and extension members, and the jaw members and extension members may also be hollow. The reduced weight of these structures makes the clamp system more portable and lighter to carry.

Figure 5:
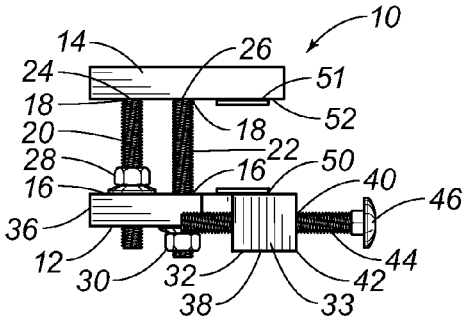
FIG. 5 is an opposite side elevation view of the embodiment of the clamp system of the present invention of FIGS. 1-2.

FIG. 5 shows an embodiment with a gripping means 51 on the flat surface 50 and complementary flat surface 52 of the jaw members 12, 14. The gripping means 51 can be comprised of tacky material, such as vinyl, cork, or rubber, which enables the clamp system 10 to grasp the frame with more friction force to prevent sliding between the jaw members 12, 14. Any known gripping means 51, such as coatings or other compositions can be used. Any gripping means 51 must remain flat for even contact against the frame by the jaw members 12, 14.

The screw means 20, 22, connect to the first jaw member 12 and to the second jaw member 14 in FIGS. 1 and 2. Each screw means 20, 22 connects aligned respective openings 16, 18 of the jaw members 12, 14. The screw means 20 is located toward an end of the jaw members 12, 14, to connect openings 16, 18, and there is a screw means 22 further from the end for another set of openings 16, 18. Embodiments of FIGS. 1-7 show fixed ends 24, 26 of the screw means 20, 22, respectively in the second jaw member 14, while the other ends extend through openings 16 of the first jaw member 12.

One screw means 22 comprises a locking nut 30 positioned between the jaw members 12, 14, while the other screw means 20 comprises a complementary locking nut 28 on an opposite side of the first jaw member 12. In this manner, the first jaw member 12 can be locked in place at a set distance from the second jaw member 14 by the threaded engagement of the screw means 20, 22 and the threaded openings 16, 18 of the respective jaw members 12, 14. This clamping action of the screw means 22 and locking nut 30 removably fix the clamp system 10 to the frame of the screen without damage to the frame. The stabilizing action of the screw means 20 and the complementary locking nut 28 provides resistance to deformation of the clamp system 10 or warping of the jaw members. Instead of pivoting at the locking nut 30, the first jaw member 12 remains stable by the resistance to lever action of the complementary locking nut 28.

In the embodiments of FIGS. 1-9, the screw means 20, 22 are complementary. The screw means are cooperative to maintain the first jaw member 12 in a stable position. The screw means 20, 22 exert opposing compressive forces against the first jaw member 12 for the locked position of the jaw members 12, 14. The lever action of the screw means 20 and complementary locking nut 28 maintains the tight clamping force of the screw means 22 and locking nut 30 on the frame. In alternate embodiments, the screw means 20, 22 can be threaded in opposite directions, and the screw means 20, 22 can be friction fit by screw threads, so as to maintain the jaw members at a set distance apart. There is no drilling or scratching or holes created on the frame. There is no permanent alteration of the frame in order to lock the clamp system 10 of the present invention.

Furthermore, one screw means can be comprised of steel, while a second screw is comprised of aluminum. In one possible embodiment, the steel screw can be the screw means 22 used for the clamping action on locking nut 30, while an aluminum screw as the other screw means 20 can be used for the stabilizing action on the complementary locking nut 28. Although the clamp system 10 may use the extra strength and durability of the steel screw for clamping onto the frame, the stabilizing force of the complementary locking nut 28 is not required to be as strong, since only a stabilizing force is required. The lighter aluminum material makes the system 10 lighter and easier to carry. The lever action at the complementary locking nut 28 may only be sufficient to reduce warping and deformation by the locking nut 30 and the frame.

Figure 3:
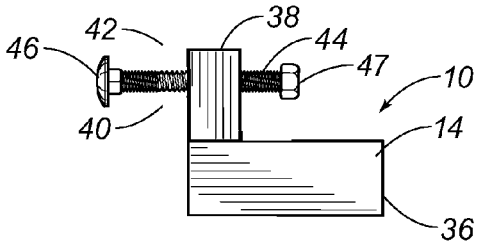
FIG. 3 is a bottom plan view of another embodiment of the clamp system, showing an extension member attached to the first jaw member.
Figure 4:
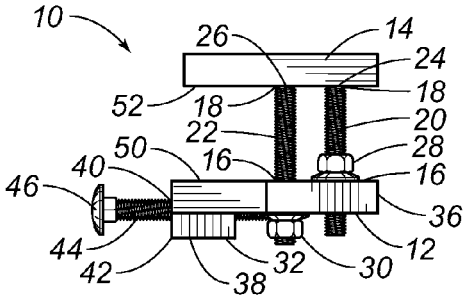
FIG. 4 is a side elevation view of the embodiment of the clamp system of the present invention of FIGS. 1-2.
Figure 6:
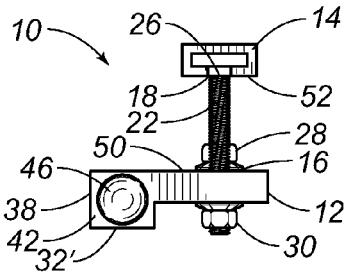
FIG. 6 is a front elevation view of another embodiment of the clamp system of the present invention.
Figure 7:
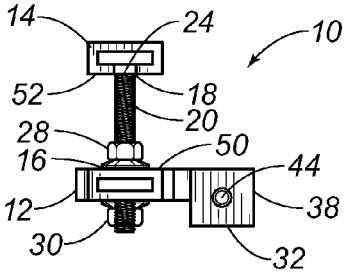
FIG. 7 is a back elevation view of the embodiment of the clamp system of the present invention of FIG. 6.

The clamp system 10 of the present invention further includes an extension member 32 attached to an end 34 of the first jaw member 12. FIGS. 1-2 and 4-5 show an embodiment with an outer sheath 33. FIG. 3 shows an embodiment with an attached extension member 32. FIGS. 6-7 alternate embodiments with an integral extension member 32', wherein FIG. 6 is consistent with the embodiments of FIGS. 1-7 and may or may not include the sheath 33. FIG. 7 shows a sheath 33.

The end 34 of the first jaw member 12 is opposite another end 36 with the openings 16, 18. At the end 34, the attached extension member 32 further comprises a housing 38 extending orthogonal to the first jaw member 12. There is a registration hole 40 on an end 42 of the housing 38, which can also be threaded. FIGS. 1, 2, 4 and 5 show the extension member 32 as a sheath 33 partially fitted over the first jaw member 12 by covering three surfaces of the end 34 of the first jaw member 12. The remaining surface is uncovered to maintain flat contact with the frame. In this embodiment, the extension member 32 as a sheath 33 forms a groove encasing the end 34 for fixed attachment to the first jaw member 12. Alternatively, friction fit sizing of the groove and jaw member 12 or other adhering means can be used for the sheath 33. Including the other embodiments of FIGS. 3 and 6-7 without the sheath, any known prior art means can be used to adhere the extension member 32 to the jaw member 12, including adhesives and making the extension member 32 integral with the first jaw member 12. Depending upon materials, soldering or adhesives may be applicable. Also, in all embodiments of FIGS. 1-7, the extension member 32 remains flush with the flat surface 50 of the first jaw member 12.

Importantly, the registration pin means 44 threadedly engages the registration hole 40 and extends parallel to the jaw members 12, 14 and orthogonal to the housing 38. The registration pin means 44 has a blunt end 46, which abuts against the platen. Similar to other systems, the registration pin means 44 insures the consistent positioning of the platen relative to the frame, and thus, the substrate. The registration pin 44 also has a threaded locking means 47, shown in embodiments of FIG. 2 and FIG. 3. The thread locking means 47 comprises a threaded screw or bolt with a hex head end and a locking nut within the housing 38. The threaded locking means 47 adjusts the position of the registration pin 44, while resisting any slight alterations of the registration pin 44 caused by repeated abutment of platens. The blunt end 46 may be an acorn nut or other equivalent structure which reduces the risk of damage to the platen. The repetitive knocking against the blunt end 46 by platens may slight move the registration pin 44 backward. The threaded locking means 47 can be tightly set through the registration hole 40 in order to resist these slight alterations. In embodiments of the present invention, a hand tool may be required to actuate the threaded locking means 47 for even setting the position, such that the resistance to the repetitive abutment of platens is further minimized. A hand tool can engage the hex head of the threaded bolt or screw of the threaded locking means 47 for rotation through the locking nut within the housing 38. Additionally, in the embodiments of FIGS. 1-9, the housing 38 of the extension member 32 may be filled with an epoxy resin. The registration pin 44 threaded passes through the housing 38 and the epoxy resin and the threaded registration 40. The epoxy resin provides further resistance to the wear of repeated mounting of platens on the clamped frame.

Figure 8:
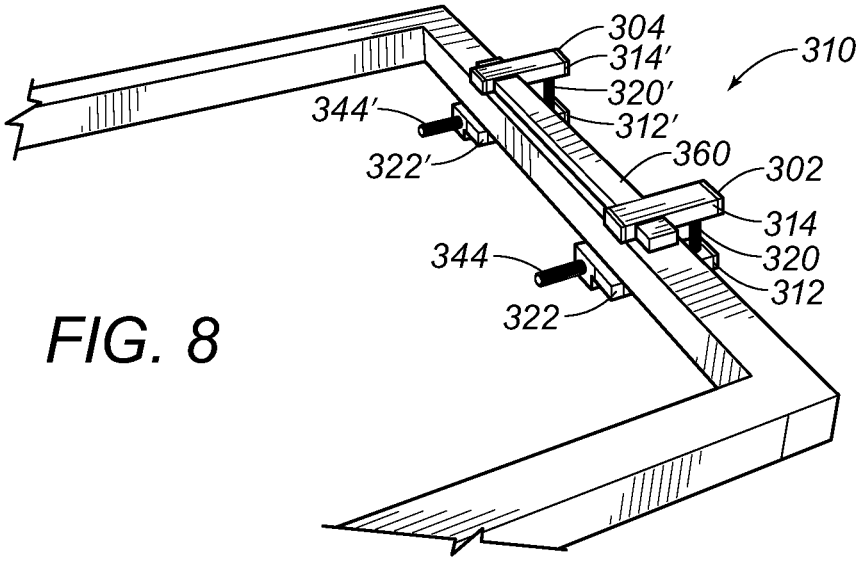
FIGS. 8-9 are other schematic perspective views of another embodiment of the system with primary and secondary clamps and a mounting bar between the clamps.
Figure 9:
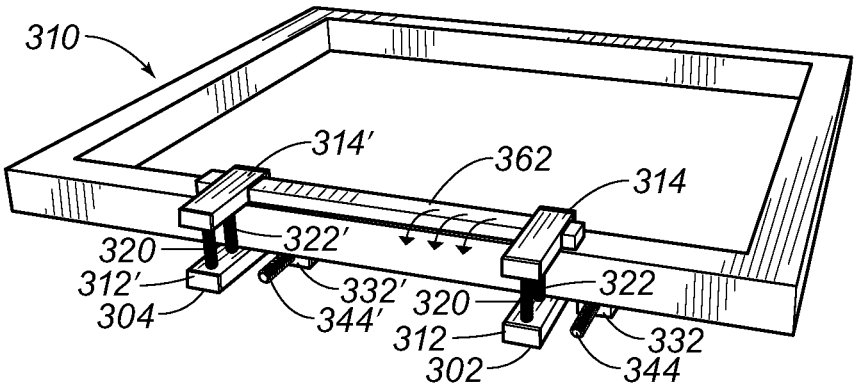

FIGS. 8-9 show still another embodiment of the present invention as a clamp system 310 of a primary clamp 302 and a secondary clamp 304. The primary clamp 302 includes the analogous first jaw member 312, a second jaw member 314, screw means 320, 322, an extension member 332, and a registration pin 344. The secondary clamp 304 includes the analogous first jaw member 312', a second jaw member 314', screw means 320', 322', an extension member 332', and a registration pin 344'. FIG. 8 shows the second jaw members 14, 14' being connected by a mounting bar 360, which is planar with the flat surface of second jaw members 314, 314', extending transverse to the length of second jaw members 314, 314' and parallel to the extension members 332, 332'. The mounting bar 360 sits atop the frame and extends through the second jaw members 314, 314'. FIG. 9 shows the second jaw members 314, 314' being connected by a mounting bar 362. In this variation, the mounting bar 362 is parallel to the screw means, 322, 322', as indicated by the arrows in FIG. 9. The mounting bar 362 has a flat surface orthogonal to the flat surfaces of second jaw members, 314, 314', extending transverse to the length of second jaw members 314, 314' and parallel to the extension members 332, 332'. FIG. 9 shows the mounting bar 362 connecting the screw means 322, 322' of the primary clamp 302 and the secondary clamp 304 and being flush to the edge of the frame. Thus, the two clamps can be used to position two registration pins 344, 344' consistently and in cooperation with each other. This embodiment provides for consistent positioning of the platen and the frame using two registration pins.

The method of clamping with the system includes mounting a frame, tightening the jaw members, stabilizing the jaw members, and setting the registration pin. The frame is mounted between the first jaw member and the second jaw member, when the frame is placed between the flat surface of the first jaw member and the complementary flat surface of the second jaw member. Then, the jaw members are stabilized against the frame by rotating the complementary locking nut so that the complementary locking nut engages the flat surface of the first jaw member. The lever action of this complementary locking nut presses against an end of the first jaw member so as to prevent buckling and loosening by the locking nut. For the step of tightening, the locking nut on the screw means is rotated so that the flat surface of the first jaw member and the complementary flat surface of the second jaw member press against opposite sides of the frame. Once stabilized and set, the registration pin is set by rotating the registration pin through the housing of the extension member. In one embodiment, the threaded locking means is actuated by a hand tool so that the screw or bolt moves through the locking nut in the housing for a set position. For the screen printing process, a platen is aligned against the blunt end of the registration pin. The position of the platen relative to the frame is identical to a position of any subsequent platen placed against the blunt end. In an embodiment of the present invention, actuating the threaded locking means on the registration pin requires a hand tool to a set and locked position. The extra resistance of the registration pin is a feature of embodiments of the present invention, which may require setting the registration pin by manual or mechanical means.

The embodiments of the present invention provide a clamp accessory for screen printing equipment that maintains alignment of the platen and screen for multiple substrates. There is identical placement of the platens relative to the frame. Thus, the substrate on the platen is always positioned in the same place, so that the ink application can be consistent and precise on the substrate. Additionally, the abutment of the flat surface of the jaw members against the frame increases the working life of the frame. Unlike the prior art with drilled holes and fixed mounts, the frame has not been altered by the present invention. The clamp system of the present invention is also removable from the frame. The friction fit attachment is created by tightening screws and moving the jaw members closer and closer together, without damaging the frame. Thus, the screen can be used over and over, even when the position of the substrate is changed for a new batch of applications.

The embodiments of the present invention also provide a clamp system with reduced risk of mechanical failure. The screws are tightened into the jaw members instead of the frame, which prevent deformation of the clamp into the wooden frame. The screw means of the present invention provides a clamping action and a stabilizing action, unlike any prior art system. The harsh clamping action is balanced by a lighter weight lever action to keep mechanical integrity of the flat surfaces holding the frame without deformation of either structure. There is pressure exerted against the frame without any contact by screws.

The registration pin of the embodiments of the present invention is positioned and aligned consistently by the jaw members and extension member of the present invention. The registration pin is parallel to the jaw members and has improved resistance to deformations and/or buckling. The threaded locking means requires a hand tool because of the tightness of the threaded engagement to the registration hole, and the housing filled with epoxy resin further resists movement of the registration pin caused by repetitive contact with platens. Additionally, the clamp system of the present invention is lighter and easier to transport when made of aluminum material and when formed of hollow structures. The clamp achieves the benefits of improved working life of the screen and consistent ink application using an innovative structure.

The foregoing disclosure and description of the invention is illustrative and explanatory thereof. Various changes in the details of the described system and method can be made without departing from the true spirit of the invention.

I claim:

1. A clamp system comprising:

a first jaw member and a second jaw member, said first jaw member being parallel aligned end to end with said second jaw member and having a flat surface facing a complementary flat surface of said second jaw member, each jaw member having a plurality of openings, openings of said first jaw member being aligned with openings of said second jaw member, said openings of each jaw member being threaded;

a plurality of screw means connecting to said first jaw member and to said second jaw member, each screw means connecting aligned respective openings of each jaw member, said screw means having fixed ends in said openings of said second jaw member and other ends extending to said openings of said first jaw member, wherein one screw means has a locking nut positioned between the jaw members, and wherein another screw means has a complementary locking nut on an opposite side of said first jaw member from said second jaw member;

an extension member attached to an end of said first jaw member, said end of said first jaw member being opposite another end with said openings, said extension member having a housing extending orthogonal to alignment of the first jaw member and the second jaw member, said housing having a registration hole on an end of said housing, said registration hole being threaded, said housing being flush with said flat surface of said first jaw member; and a registration pin means threadedly engaging said registration hole and extending parallel to the jaw members and orthogonal to said housing, the pin means having a blunt end and a threaded locking means.

2. The clamp system, according to claim 1, wherein said openings of each jaw member are arranged linearly lengthwise along each jaw member, respectively.

3. The clamp system, according to claim 2, wherein said openings are in parallel alignment to edges of each jaw member, respectively.

4. The clamp system, according to claim 1, wherein said screw means are complementary.

5. The clamp system, according to claim 4, said screw means being threaded in opposite directions.

6. The clamp system, according to claim 4, wherein said locking nut and said complementary locking nut are positioned so as to exert opposing compressive forces against said first jaw member, said first jaw member being held in a locked position relative to said second jaw member.

7. The clamp system, according to claim 6, said jaw members being friction fit at a set distance apart.

8. The clamp system, according to claim 1, wherein said extension member is comprised of an outer sheath partially fitted over three surfaces of said first jaw member.

9. The clamp system, according to claim 8, wherein said extension member has a groove encasing said end 34 of said first jaw member.

10. The clamp system, according to claim 8, wherein said extension member is made integral with said first jaw member.

11. The clamp system, according to claim 1, wherein said screw means is comprised of a first screw and a second screw, said first screw and said locking nut exerting a compressive force of said first jaw member towards said second jaw member, said second screw being positioned closer to said end of the jaw members opposite said extension member, said second screw and said complementary locking nut exerting a compressive force against said first jaw member.

12. The clamp system, according to claim 11, said first screw being comprised of steel, said second screw being comprised of aluminum.

13. The clamp system, according to claim 1, wherein said first jaw member, said second jaw member, and said extension member are comprised of aluminum.

14. The clamp system, according to claim 13, wherein said first jaw member, said second jaw member, and said extension member are hollow.

15. The clamp system, according to claim 1, further comprising:

a gripping means mounted on said flat surface of said first jaw member and on said complementary flat surface of said second jaw member.

16. The clamp system, according to claim 1, wherein said housing is filled with an epoxy resin, said registration pin threaded passing through said housing and said epoxy resin.

17. The clamp system, according to claim 1, further comprising:

a mounting bar attached to said second jaw member, said mounting bar extending orthogonal to the second jaw member and attaching to an adjacent clamp system.

* * * * *